US005803189A

United States Patent [19]

Geldner

[11] Patent Number: 5,803,189

[45] Date of Patent: Sep. 8, 1998

[54] DIRECTIONAL BORING MACHINE

[76] Inventor: Robert L. Geldner, Rte. 1, Box 199, Cleveland, Minn. 56017

[21] Appl. No.: 701,096

[22] Filed: Aug. 21, 1996

[51] Int. Cl.[6] ..... E21B 3/02

[52] U.S. Cl. ..... 175/113; 175/122; 175/162; 175/195; 175/203

[58] Field of Search ..... 175/113, 122, 175/162, 195, 202, 203

[56] References Cited

U.S. PATENT DOCUMENTS

| | | | |
|---|---|---|---|
| 3,718,367 | 2/1973 | Schumacher . | |
| 3,990,522 | 11/1976 | Pyles et al. . | |
| 4,149,604 | 4/1979 | Lockwood et al. . | |
| 4,371,041 | 2/1983 | Becker et al. . | |
| 4,553,612 | 11/1985 | Durham | 175/202 X |
| 4,703,811 | 11/1987 | Lam . | |
| 4,892,161 | 1/1990 | Ebeling | 175/195 |
| 4,976,321 | 12/1990 | Van Meter | 175/113 X |
| 5,033,554 | 7/1991 | Younes . | |
| 5,039,068 | 8/1991 | Venturini et al. . | |
| 5,054,565 | 10/1991 | Kinnan . | |
| 5,158,146 | 10/1992 | Fuller . | |
| 5,236,054 | 8/1993 | Jack et al. . | |
| 5,273,124 | 12/1993 | Lloyd et al. . | |
| 5,289,887 | 3/1994 | Püttmann | 175/162 X |
| 5,388,653 | 2/1995 | England | 175/162 X |

OTHER PUBLICATIONS

American Directional Drill brochure; DD–60/DD–90 Mobile, High Powered Units (4 p).
American Directional Drill brochure; DD–15/DD–30 Directional Drills (4 p).
American Directional Drill brochure; DD–160/DD–330/DD–500 (4 p).
American Augers Inc. brochure; 10 solid reasons why our augers are your best buy (2 p).
American Augers Inc. Newsletter; Jul./Aug. 1994 (4 p).
American Augers Inc. Newsletter; Sep./Oct. 1994 (4 p).
American Augers Inc. brochure; 29th Trenchless Technology Seminar; Feb. 26–Mar. 5, 1995 (2 p).
American Augers Inc. brochure; Performance; Hard Work; Guts. (1 p).
American Augers brochure; Rock Drilling (2 p).
American Tunneling Equipment brochure; Bores Head American Augers (4 p).
American Tunneling Equipment brochure; Microtunneling (2 p).
bor–mor brochure; Self–Contained Directional Drilling Equipment Model 400TX (4 p).
Ardco Industries brochure; BoreKing Directional Boring Systems Model DBS–1000 (2 p).
Ardco Industries brochure; BoreKing Directional Boring Systems Model DBS–2500 (2 p).
Vermeer brochure; Navigator (6 p).
Vermeer Underground Construction Equipoment Catalog (14 p).
Surface to Surface Directional Drilling Systems brochure; Model 212B (2 p).
Accu–dril brochure; Dumand Project: Keahole Point, Hawaii (2 p).
Long's Underground Technologies, Inc. brochure; Environmentally Sensitive Horizontal Boring (2 p).

*Primary Examiner*—Roger J. Schoeppel
*Attorney, Agent, or Firm*—Merchant, Gould, Smith, Edell, Welter & Schmidt, P.A.

[57] ABSTRACT

A directional boring machine is disclosed which is capable of drilling substantially horizontal underground bores of significant length. The boring machine includes a movable carriage, a longitudinal boom mounted on the carriage and a drill head that is mounted on the boom for forward and reversible movement. A first drive normally advances the drill head to accomplish the drilling operation. When an obstacle is encountered, a second drive may be utilized to supplement the first drive to overcome the obstacle. The boom is itself longitudinally slidable relative to the carriage, and the boring machine includes a structure for longitudinally moving the boom between an extended operating position and a retracted transport position.

10 Claims, 9 Drawing Sheets

FIG. 7A
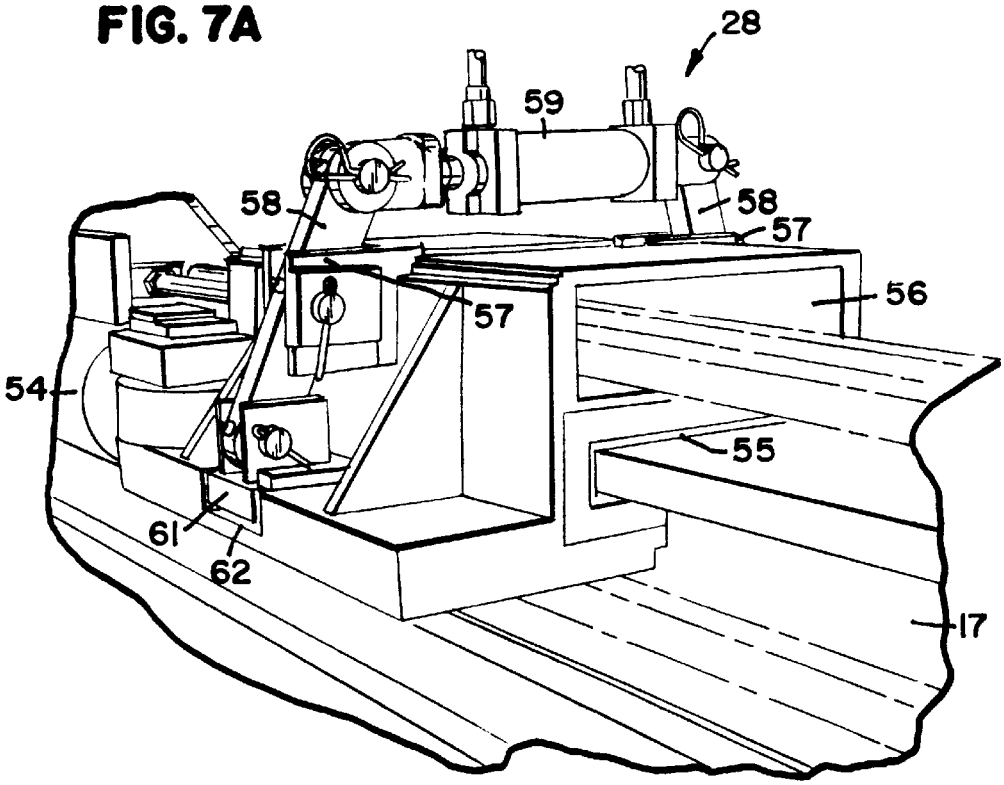
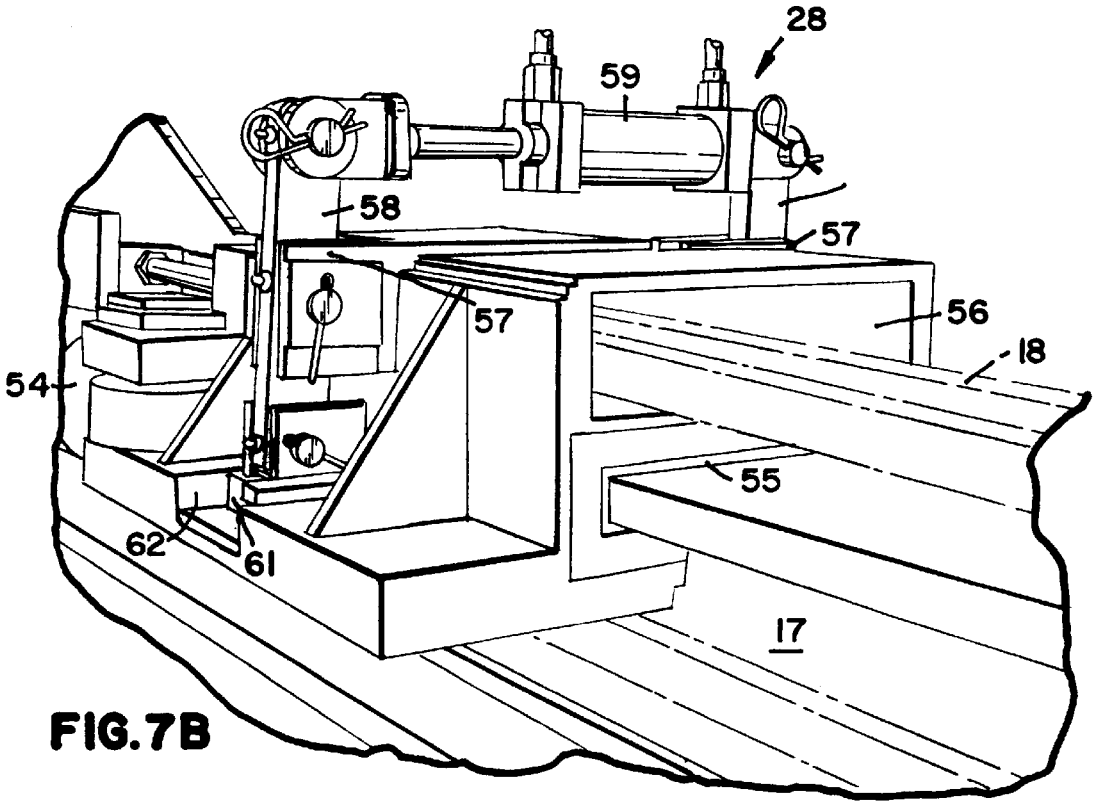
FIG.7B

DIRECTIONAL BORING MACHINE

The invention broadly relates to directional boring machines and is specifically directed to a machine having a first drive mechanism for normal operation and a second drive mechanism that supplements the first drive mechanism when drilling obstacles are encountered.

Directional boring machines are used to drill underground bores that generally run in a horizontal direction, and typically include an elongated boom having a drill head that moves longitudinally forward and rearward over the length of the boom. The boom is angled relative to the surface to be drilled at an angle ranging from 5° to 25°. The drill head includes a rotating spindle, generally driven by a hydraulic motor, to which one or more elongated drill stems are detachably connected.

Conventional directional boring machines operate by connecting one end of a first drill stem to the rotating spindle of the drill head and connecting a drill bit to the opposite or outer end. With the drill head in a retracted position on the boom, spindle rotation begins and the drill head is advanced down the boom resulting in the drilling of a bore. When the drill head reaches the outer boom end, the drill stem is detached from the drill head spindle and the drill head is retracted to its original position. One end of the second drill stem is then mounted to the spindle with its opposite end connected to the existing drill stem. The drilling process then continues until the drill head again reaches the end of the boom, and the process is repeated.

The drill stems are typically hollow to permit the flow of a drilling lubricant that is discharged through the drill bit at the point of drilling.

The drill stems are relatively rigid, and the bore that is being drilled initially extends in a straight direction at an inclined angle that corresponds to the angle of the boom. The angle of drilling may be altered so that, when a desired depth is reached, the drilling operation is changed to horizontal. When the underground bore is of the desired length, the drill bit can be directed angularly upward until it re-emerges at ground surface. The position of the drill bit, both with respect to direction and depth, may be determined by a conventional electronic transmitter located in the drill bit and an electronic receiver that is carried on the ground surface.

Directional boring machines are capable of drilling underground bores of considerable length. However, a recurring problem particularly with larger machines that drill very long bores is encountering obstacles such as large boulders at a point remote from the machine. The problem is compounded by the distance to the obstacle because decreasing power is transferred to the drill bit as the number of drill stems increase; i.e., increasing power must be used to rotate the increasing number of drill stems and less power is available to transfer to the drill bit. Conventional drilling techniques overcome some obstacles by drilling around them, but this involves redrilling in part and also requires a base of increased length. Overcoming longer obstacles therefore involves considerable difficulty, more time and greater expense to complete the drilling task.

The inventive directional boring machine is designed to overcome most obstacles. It utilizes the normal or primary drive mechanism for underground soil that does not include significant obstacles, and a second drive mechanism that can be actuated to supplement the primary drive mechanism when an obstacle is encountered.

Specifically, a locking mechanism that is separate from the drill head is carried therewith by interconnection to the drill head through which a pair of large hydraulic actuators. During normal operation, the primary drive mechanism moves the drill head longitudinally down the boom. However, when an obstacle is encountered, the locking mechanism clamps to the boom and the secondary drive mechanism (the larger hydraulic actuators). Actuation of the locking mechanism does not disable the primary drive mechanism, but rather provides an abutment platform against which the large hydraulic actuators may simultaneously act. As these actuators are extended, their driving force supplements the primary drive mechanism, producing a combined drilling force sufficient to overcome most if not all obstacles.

In addition, the inventive directional boring machine includes a novel mechanism for longitudinally moving the boom between operating (drilling) and transport positions. This is accomplished by slidably mounting the boom on a guide member carried by the frame and providing two separately operated locking mechanisms the first of which selectively locks the boom to the guide member and the second of which selectively locks the drill head to the guide member. During drilling operations, the boom is locked to the guide member by the first locking mechanism to prevent its slidable movement relative to the guide member, and the second locking mechanism is unlocked to permit forward and rearward movement of the drill head on the boom.

To retract the boom to a transport position, the drill head is locked to the guide member and the boom is unlocked from the guide member. Operation of the primary drill head drive mechanism in this state cannot impart movement to the locked drill head, but rather imposes a longitudinal force on the unlocked boom, causing it to slidably retract to a transport position. The boom may be extended to the operative position by reversing this procedure.

The inventive directional boring machine provides the ability to overcome obstacles in the line of the intended bore, and in so doing avoids the loss of time and material necessitated by circumventing the obstacle. The improved boom control enables the operator to retract the boom for transport in a simple and efficient manner.

BRIEF DESCRIPTION OF THE DRAWINGS

FIG. 7A is a fragmentary sectional view of the drill head locking means viewed from the side and front with the locking means in the release or nonlocking position;

FIG. 7B is a view similar to FIG. 7*a* with the locking means in a locking position;

DETAILED DESCRIPTION OF THE PREFERRED EMBODIMENT

Figure 1:
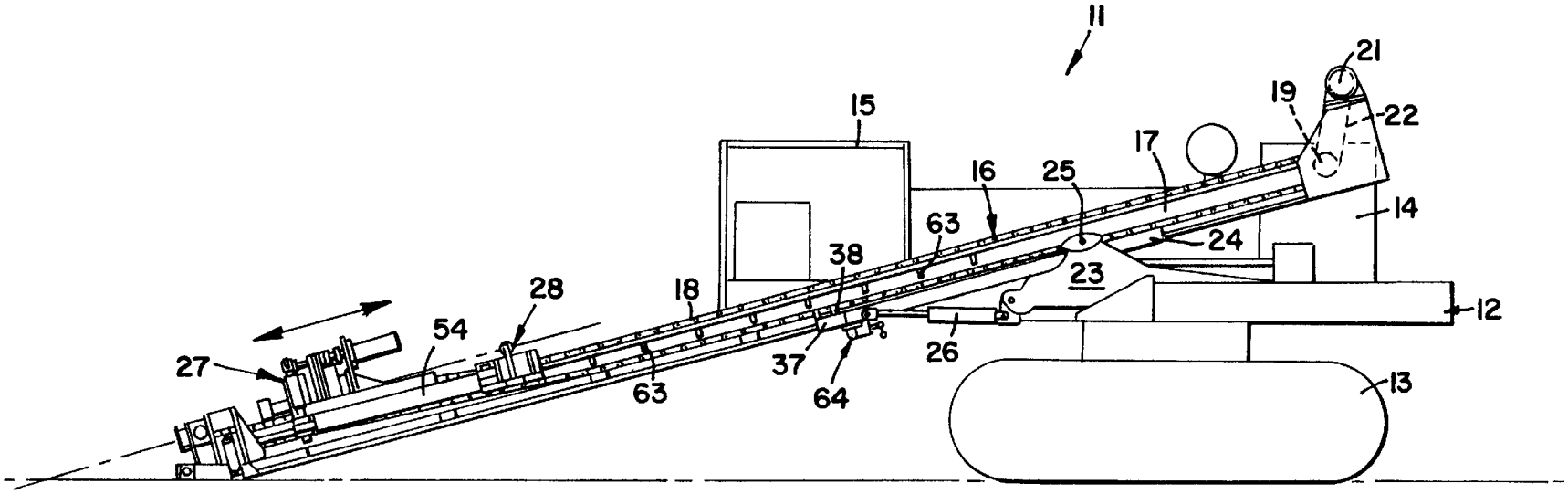
FIG. 1 is a side elevational view of a directional boring machine embodying the invention having a drill head boom in an operative position.
Figure 2:
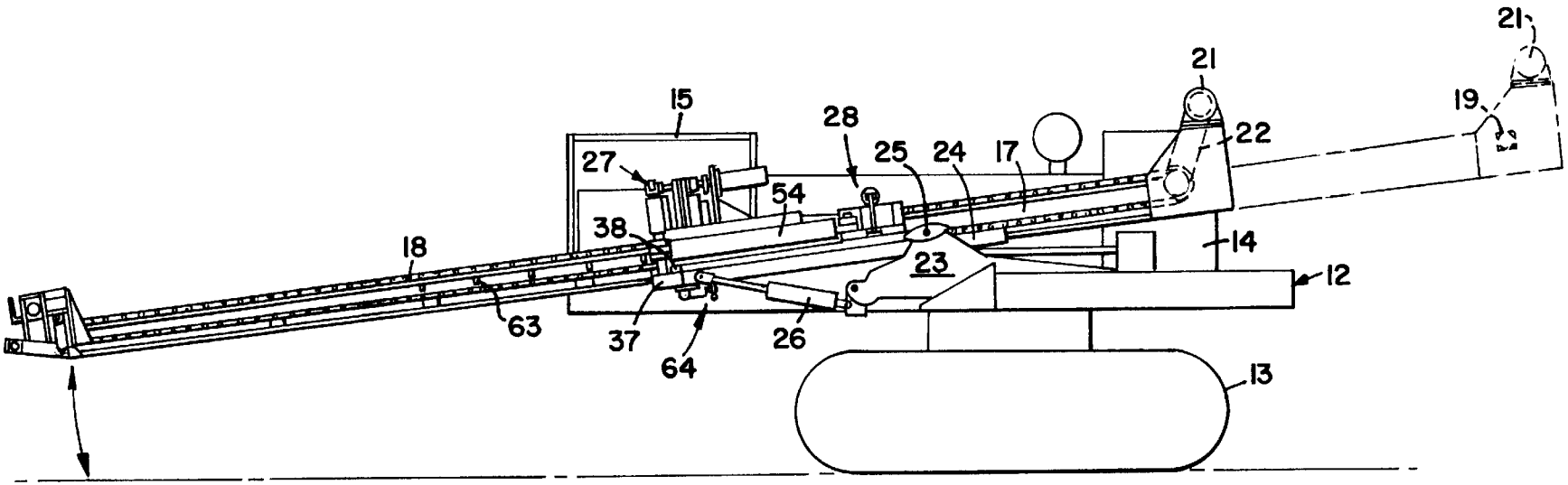
FIG. 2 is a view similar to FIG. 1 with the drill head boom tilted to a nonoperative position and with the boom shown in phantom in a retracted transport position.
Figure 3:
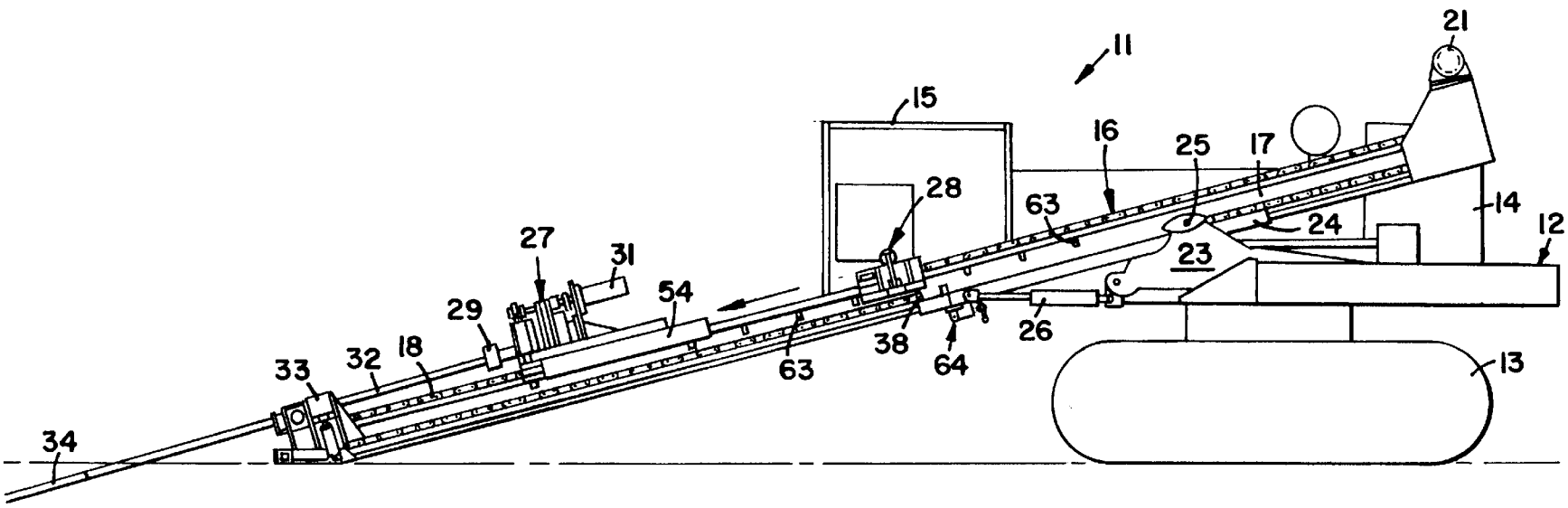
FIG. 3 is a view similar to FIGS. 1 and 2 with the drill head boom in an operative position and with the drill head operated by a secondary power drive.

With initial reference to FIGS. 1–3, a directional boring machine embodying the invention is represented generally by the numeral 11. Machine 11 broadly comprises a carriage or frame 12 movable on an endless track 13. The endless track 13 and all other powered mechanisms of machine 11, including hydraulic pumps, motors and actuators, are conventionally driven by a power plant 14 mounted on carriage 12. Machine 11 is operated from a control station 15 which includes an operator's seat and various conventional control mechanisms.

Machine 11 further comprises an elongated boom bearing the general reference numeral 16 which, as described in further detail below, includes an elongated I-beam 17 and a pair of symmetrically disposed drive chains 18 each having an upper and a lower flight that respectively travel along the top and bottom guideways of the I-beam 17.

Each of chains 18 has first and second chain ends and is formed into an elongated loop having forward and rearward loop ends. The rearward chain loop end is driven by a drive sprocket 19 that is in turn driven by a hydraulic motor 21 and drive belt or chain 22. The forward loop end of each chain 18 is rotatably carried by an idler sprocket mounted to I-beam 17 (not shown).

Figure 4:
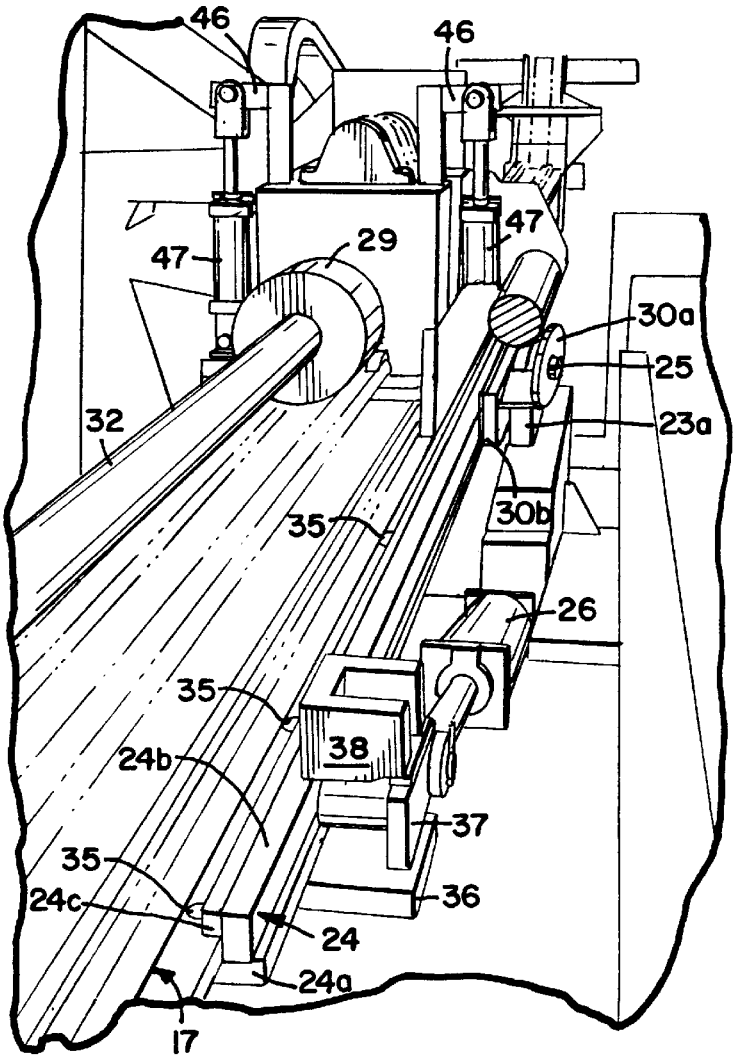
FIG. 4 is a fragmentary perspective view of the directional boring machine as viewed rearwardly from a forward point on the boom.

Boom 16 is mounted for both pivotal and longitudinally sliding movement relative to carriage 12 through the use of a pair of beam support members 23 that are symmetrically disposed on each side of boom 16. The support members 23 support an elongated guide member 24 that is disposed in underlying relation to and which slidably mates with the lower flanges of I-beam 17. Guide member 24 is pivotally movable relative to beam support member 23 through a pivot pin 25 the details of which are best shown in FIG. 4. As shown, beam support member 23 has an upwardly projecting ear 23*a* that is received in a recess defined by a pivot member 30*a* mounted to a bracket plate 30*b*. Bracket plate 30*b* is secured to elongated guide member 24 at a rear portion thereof. Pivot pin 25 extends through the pivot member 30*a*, gear 23*a* and bracket plate 30*b* to permit the associated guide member 24, and hence the elongated boom 16, to pivot relative to the beam support members 23.

The boom 16 may be pivoted by a pair of hydraulic actuators 26 operably mounted on each side of boom between beam support member 23 and the respective guide members 24 between a lower operating position as shown in FIG. 1 and an upper transport position as shown in FIG. 2.

Boom 16 may also be moved between extended and retracted positions as shown in FIG. 2, and may be locked in either of these positions or in intermediate positions. The extension-retraction and position locking mechanisms are described in further detail below.

A drill head represented generally by the numeral 27 is slidably mounted on I-beam 17 and connected to opposite ends of each of the chains 18 as described in greater detail below. This connection permits the drilling head 27 to be moved longitudinally forward and rearward on I-beam 17 during the drilling operation. A drill head locking mechanism 28 is operably connected to the rear portion of drill head 27 and slides on I-beam 17 therewith.

With reference to FIG. 3, drill head 27 includes a rotatable spindle 29 that is rotatably driven by a hydraulic motor 31. A drill stem 32 is threadably mounted into the spindle 29 and rotated thereby. A drill bit 34 is detachably mounted to the extreme end of drill stem 32. A plurality of drill stems 32 are used to bore to the desired length, each of which is typically 10 or 20 feet in length. Machine 11 conventionally operates by rotating the drill stems 32 and drill bit 34 by the hydraulic motor 31 while at the same time advancing drill head 27 toward the extreme end of the boom through the use of hydraulic motor 21 and the drive chains 18.

As drill head 27 reaches the extreme outer end of boom 17, the closest drill stem 32 is unthreaded from spindle 29 through the use of a drill stem clamp 33 that is hydraulically operated. When clamp 33 is actuated, drill stem 32 is prevented from rotating. Spindle 29 may then be reversibly rotated by hydraulic motor 31, thus unscrewing drill stem 32 from spindle 29. Drill head 27 may then be retracted by chain 18, and a new drill stem 32 is threadably inserted between the existing drill stem and the retracted spindle 29. The drilling operation then resumes by forward rotating of spindle 23 and advancing of drill head 27 toward the extreme end of boom 17. Additional drill stems 32 are added until an underground bore of proper length is obtained.

The drill bit 34 conventionally takes the form of a curved or tapered duck bill bit that bores a hole as the drill stem 32 is rotated and drill head 27 is advanced by chain 18. The drill bit drills a straight bore as it is rotated. However, the direction of the drill bit, and hence the direction of the resulting bore, may be changed by stopping the hydraulic motor 31 with the drill bit pointing in the desired direction. Drill head 27 is then advanced on I-beam 17 without rotation of the spindle 29 until the drill bit changes direction due to its angle or curvature, at which time rotation of the spindle 29 begins again. The drill bit thereafter bores a straight hole in the new direction until the direction is changed by the same process. The drill stems 32 are substantially rigid, but they have the capability of flexing and bending over the significant length of a bored hole.

In the preferred embodiment, spindle 29 is hollow, as is each of the drill stems 32. A conventional drilling lubricant, preferably taking the form of a slurry of Bentonite, is continuously supplied through the drill stems 32 to the drill bit, which in the preferred embodiment includes one or more discharge outlets enabling the flow of lubricant at the point of drilling. The Bentonite slurry is conventionally pumped to drill head 27 through a hydraulic line (not shown). Machine 11 may include a tank (not shown) for the Bentonite slurry and a pump that continuously pumps the slurry to the drilling head 27.

With reference to FIG. 4, guide member 24 comprises three elongated steel bar components 24*a*, 24*b*, 24*c* that collectively define an internally facing groove or channel that receives and slidably guides the lower flange of I-beam 17. The I-beam flange includes a plurality of apertures 35 spaced therealong the purpose of which is described below.

With continued reference to FIG. 4, a guide member 24 is disposed on each side of I-beam 17. The two guide members 24 are interconnected by a transverse beam member 36. A bracket 37 is carried at each end of the beam member 36 to support a U-shaped pocket member 38. Pocket member 38 may be seen in FIGS. 1, 2 and 3 and its purpose is disclosed below.

Figure 5:
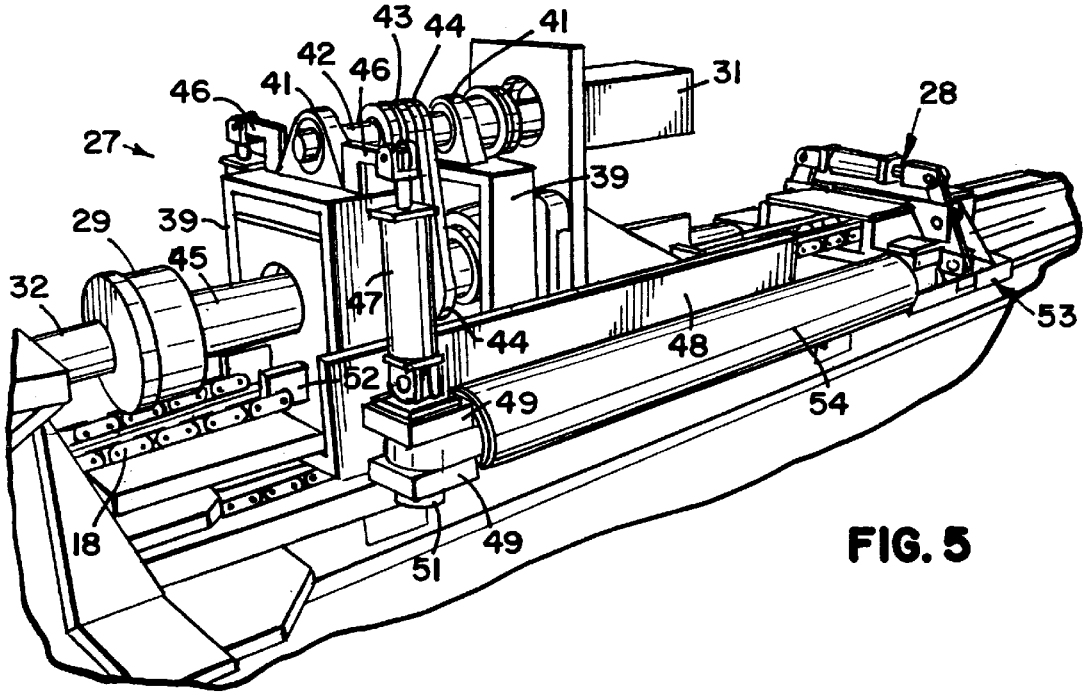
FIG. 5 is a fragmentary perspective side view of the drill head and locking means therefor.

With continued reference to FIGS. 4 and 5, drill head 27 includes a frame formed from a plurality of structural members. A pair of aligned box-shaped frame members 39 carry a pair of journals 41 in which a drive shaft 42 leading from hydraulic motor 31 is rotatably supported. A drive pulley 43 carries a plurality of drive belts 44 that encircle driven pulleys (not shown) on a larger driven shaft 45 that carries spindle 29.

A pair of ear brackets 46 are mounted on the top of the forward box frame 39 and project laterally outward to receive the upper end of a pair of hydraulic actuators 47.

An elongated channel member 48 underlies and supports the two box frames 39. A pair of spaced bracket members 49 project laterally outward from each side face of the channel member 48 to receive and support the actuators 47. The lower end of each actuator 47 includes a pin 51 that may be extended into and retracted from the pocket member 38 described above.

With continued reference to FIG. 5, the forward end of each length of chain 18 is connected to the drill head 27 by a connecting tab 52.

The drill head locking mechanism 28 is also constructed to slide along I-beam 17 in trailing relation to drill head 27. With additional reference to FIGS. 7A and 7B, locking mechanism 28 includes a slidable frame 53 that mates with the upper flanges of I-beam 17. As best shown in FIG. 5, a large hydraulic actuator 54 has one end mounted to the slidable frame 53 with the opposite end connected between the bracket members 49 of the drill head 27. A second actuator member 54 is symmetrically located on the opposite side of drill head 27. The two actuators 54 operably connect the drill head 27 and locking mechanism 28, which are otherwise separate components.

Figure 6:
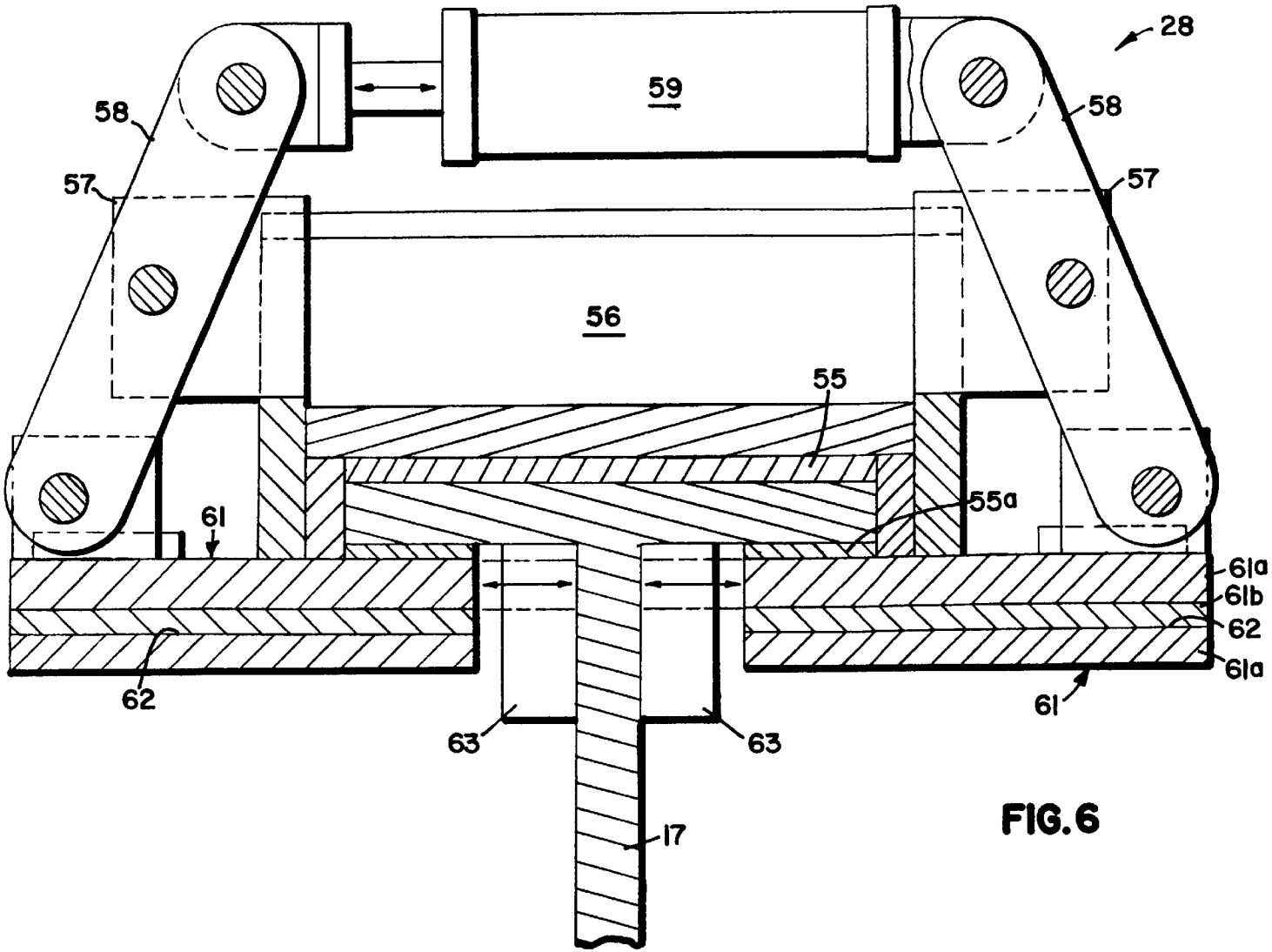
FIG. 6 is an enlarged fragmentary end view of the drill head locking means with portions thereof shown in transverse section.

With reference to FIGS. 6, 7A and 7B, slidable frame 53 of drill head locking mechanism 28 defines a longitudinal channel 55 that is constructed and sized to slidably receive the upper flange of I-beam 17. Channel 55 is lined with a layer 55*a* of neoprene to facilitate sliding movement. A large rectangular open channel 56 is disposed above the channel 55 and adapted to receive the two chain lengths 18 which pass therethrough for connection to the rear side of drill head 27 in a manner similar to the connection to connecting tabs 52, but not shown.

As indicated above, the drill head 27 and locking mechanism 28 slide together through the movement of chain lengths 18 based on their operable connection through actuators 54. However, it is possible to lock locking mechanism 28 onto the upper flange of I-beam 17 against further movement, and to thereafter drive drill head 27 longitudinally over I-beam 17 by actuating hydraulic actuators 54.

With continued reference to FIGS. 6, 7A and 7B, frame 53 includes a pair of laterally projecting ears 57, and an actuating fulcrum link 58 is pivotally connected to each of the ears 57 at an intermediate point. The upper ends of the fulcrum links 58 are respectively connected to opposite ends of a hydraulic actuator 59. The lower ends of fulcrum links 58 are respectively connected to the outer ends of transversely movable sliding bars 61 that ride in channels 62 formed in slidable frame 53. As best shown in FIG. 6, each of the slidable bars 61 comprises a pair of metal plates 61*a* between which a layer 61*b* of neoprene is sandwiched.

It will be appreciated that retraction of the hydraulic actuator 59 simultaneously draws in the fulcrum links 58, which in turn retracts the sliding bars 61. Conversely, extension of hydraulic actuator 59 moves the fulcrum links 58 to their outer most position, which in turn forces the sliding bars 61 laterally inward into engagement with the central or web member of I-beam 17.

With continued reference to FIGS. 1 and 6, a plurality of teeth 63, each taking the form of a rectangular metal plate, are welded along the upper portion of each side of I-beam 17 in underlying relation to the upper flange. The teeth 63 are disposed in uniformly spaced relation, and are positioned to be longitudinally engaged by the sliding bars 61 when they are moved laterally inward in response to the extension of hydraulic actuator 59. With the drill head locking mechanism 28 in any of several positions between the various teeth 63, extension of hydraulic actuator 59 moves the sliding bars 61 laterally inward, and the selected pair of opposed teeth 63 thereafter provide a fixed abutment against which the locking mechanism 28 acts.

More specifically, as explained above, drill head 27 is normally advanced along boom 17 by the chains 18 to perform the desired drilling operation. Periodically the drill bit 34 encounters an obstacle such as a large boulder, and further boring is impeded because the hydraulic motor 21 lacks sufficient power to advance drill head 27 with the chains 18. At this point, hydraulic actuator 59 may be extended to move sliding bars 61 inward into abuttable engagement with a selected pair of teeth 63, and thereafter the large hydraulic actuators 54 disposed between locking mechanism 28 and drill head 27 may be used as a secondary driving mechanism for drill head 27. The chains 18 continue to operate because the only interconnection between locking mechanism 28 and drill head 27 is the large hydraulic actuators 54; i.e., actuation of the locking mechanism 28 does not prevent operation of the chains 18. As such, the hydraulic actuators 54 supplement the chains 18, and the combined forces are sufficient to overcome most if not all obstacles.

If the obstacle has a greater depth than the stroke of the actuators 54, the locking mechanism 28 may be released, the actuators 54 retracted and the chain 18 advanced until the obstacle is again struck. Locking mechanism 28 is then again actuated to the locking position, and the boring operation continues under the combined power of the chains 18 and hydraulic actuators 54 (FIG. 3). This operation can also be combined with adding drill stems 32 as necessary, which enables the drill head 27 and locking mechanisms 28 to be retracted to a rearward point on boom 17 as discussed above.

After the obstacle has been cleared, actuator 59 may be retracted to unlock the locking mechanism 28, and boring operations continue under the power of the primary drive mechanism, i.e., hydraulic motor 21 and chains 18.

As indicated above, the lower flange of I-beam 17 includes a plurality of longitudinally spaced apertures 35. These apertures are used in conjunction with a boom locking mechanism 64 that is generally shown in FIGS. 1–3 and specifically shown in FIGS. 8, 9A and 9B, to which reference is now made.

An ear bracket 65 is affixed to and projects downwardly from transverse beam member 36. A small hydraulic actuator 66 has one end pivotally connected to the ear bracket 65. The opposite end of actuator 66 is pivotally connected to a linkage mechanism consisting of a pair of lower pivotal links 67 and a pair of upper pivotal links 68 (see FIG. 8). The connection of the extending end of actuator 66 and the links 67, 68 is through a pivot pin 69 (FIGS. 9A, 9B).

Figure 8:
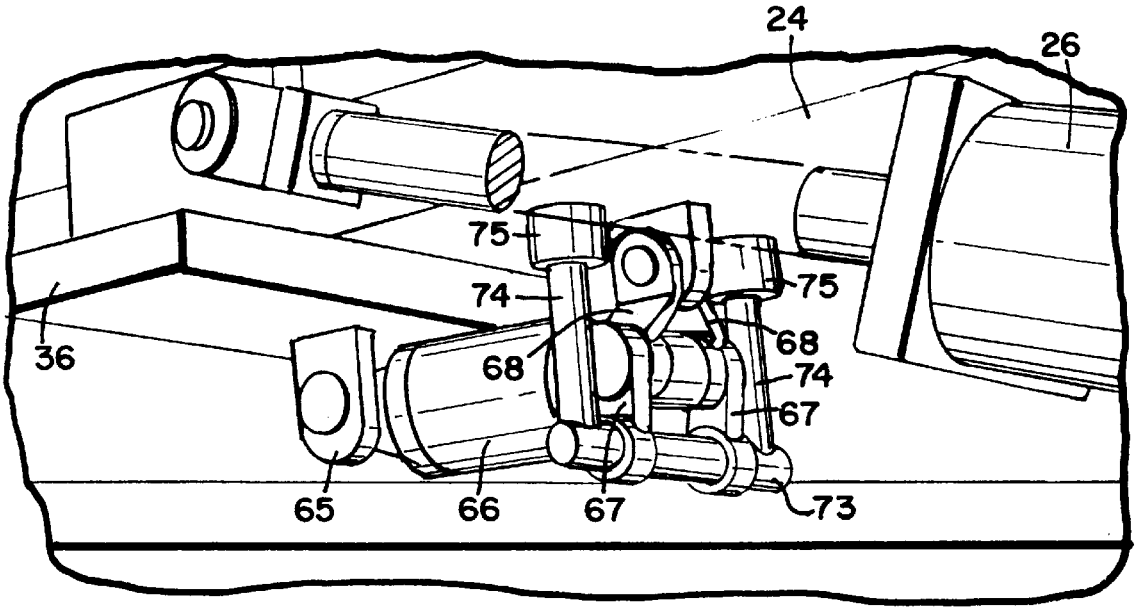
FIG. 8 is an enlarged fragmentary view of a boom locking mechanism with portions thereof shown in section.

The upper links 68 are connected through a pivot pin 71 to an ear bracket 72 that is secured to the bottom surface of the boom guide member 24. The lower links 67 are pivotally connected to a transverse pivot pin 73. As best shown in FIG. 8, a pair of locking pins 74 are affixed to the opposite ends of pivot pin 73 and project upwardly therefrom. The upper ends of locking pins 74 are slidably received in a pair of bushings 75. The bushings are aligned with a bore 76 formed in the bottom member 24*a* of boom guide member 24. The longitudinally spaced apertures 35 formed in the lower flange of I-beam 17 are positioned to be selectively registered with the bore 76 as shown in FIGS. 9A and 9B.

Figure 9A:
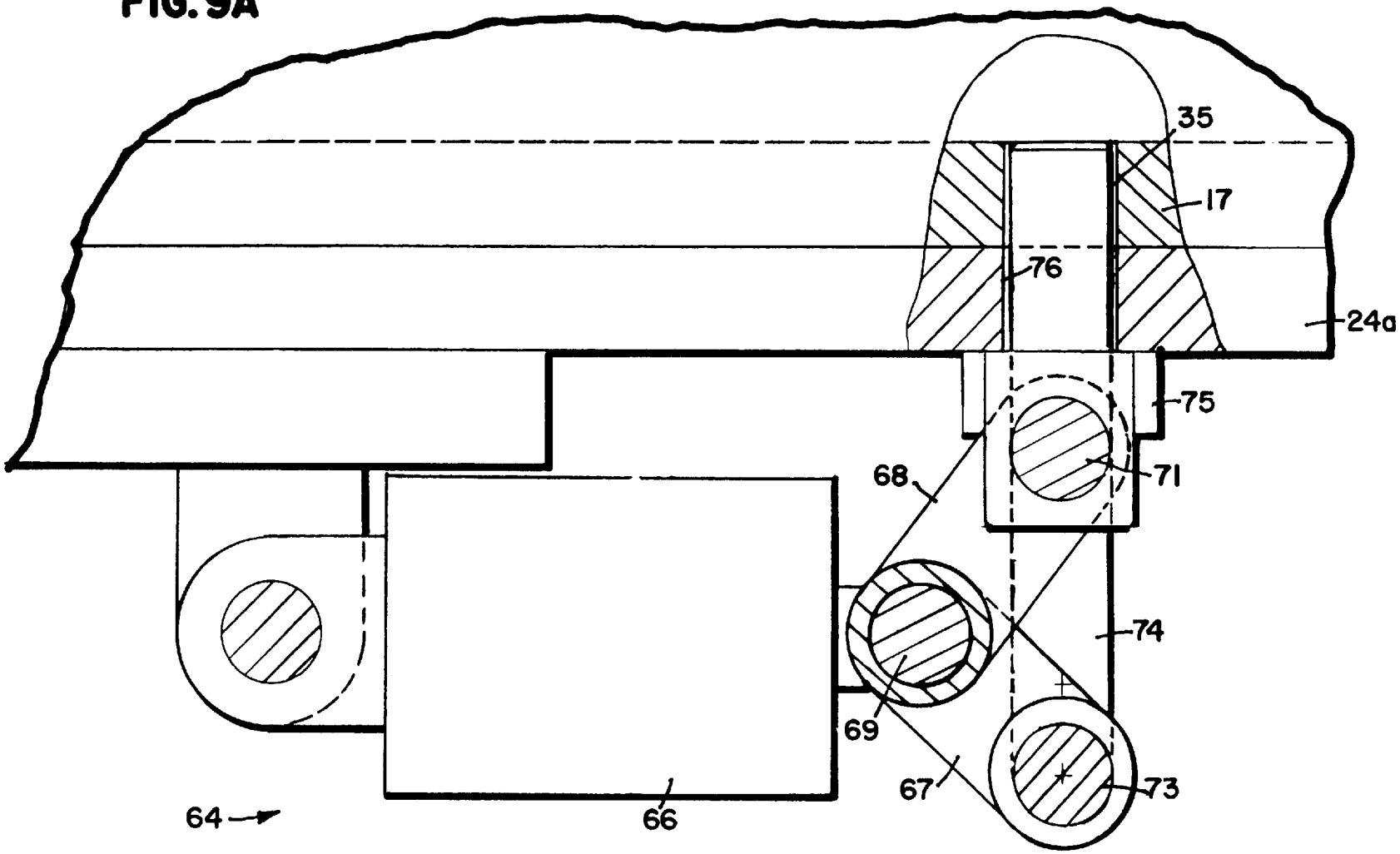
FIG. 9A is a further enlarged fragmentary side elevational view of the boom locking mechanism in a locking or extended position with portions thereof shown in section.
Figure 9B:
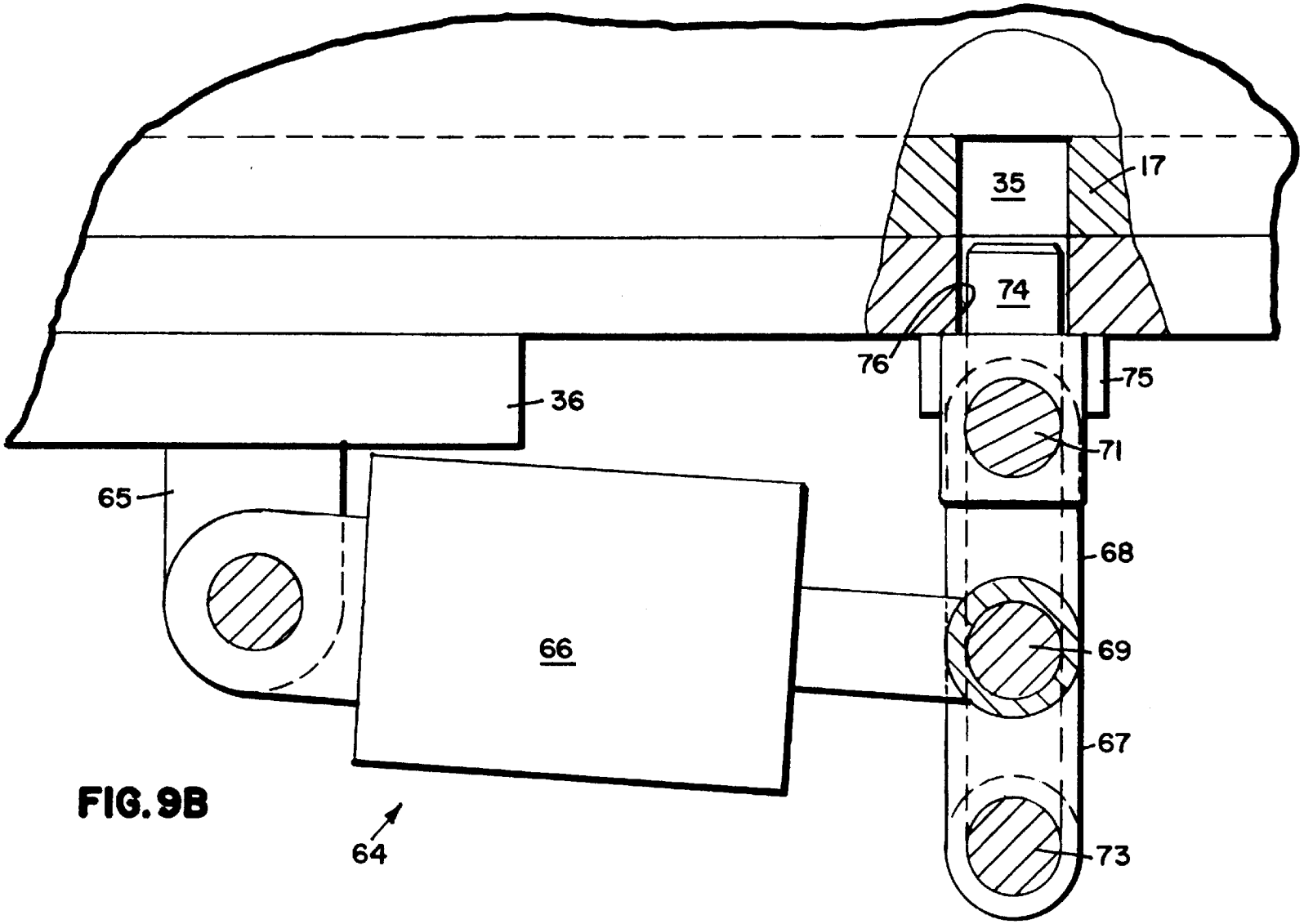
FIG. 9B is a view similar to FIG. 9*a* with the boom locking mechanism in a retracted position.

With continued reference to FIGS. 9A and 9B, the boom 17 must be locked to the boom guide member 24 during drilling operations, and this is accomplished through the use of boom locking mechanism 64. With one of the apertures 35 in registration with the bore 76, actuator 66 is retracted, drawing with it pivot pin 69 and the lower and upper lengths 67, 68. Since the upper end of upper length 68 is fixed to pivot pin 71, the lower end of lower length 67 and transverse pivot pin 73 are moved upward by the retracting movement of actuator 66. This in turn causes the locking pin 74 to move upward through bushings 74, projecting into the selected pair of opposed apertures 35 (FIG. 9A). In this position, I-beam 17 cannot slide longitudinally relative to the underlying guide member 24.

Unlocking of the I-beam 17 is accomplished by extending the small actuator 66, which forces pivot pin 69 outward and to move lower and upper actuating links 67, 68 into the position shown in FIG. 9B. This causes transverse pivot pin 73 to be lowered, taking with it the two locking pins 74, and they are retracted from the selected opposed apertures 35. In this position, I-beam 17 may slide longitudinally relative to the underlying guide member 24.

Unlocking locking mechanism 64 is one of several steps necessary to cause I-beam 17 to slide longitudinally forward or rearward between the operating position of FIGS. 1 and 3 and the transport position of FIG. 2. Assuming that the boom 16 is in the position shown in FIG. 1 and that boom locking mechanism 64 is in the locking position shown in FIG. 9A, boom 16 may be moved to the transport position of FIG. 3 by first extending hydraulic actuators 26 to pivot boom 16 upwardly to the position shown in FIG. 2. Drilling head 27 is then moved rearward along beam 16 by chains 18 to the position shown in FIG. 2, in which the extension pins 51 of actuator 47 (FIG. 5) are in vertical alignment with the pockets 38 (FIG. 4). Actuators 47 are then extended so that pins 51 enter the pockets 38. This prevents relative movement of drilling head 27 with respect to the underlying guide member 24.

Boom locking mechanism 64 is then unlocked by retracting small actuator 66 as described above, which retracts the locking pins 74 from the selected pair of opposed apertures 35.

In this position, the drilling head 27 is locked to the guide member 24 but the boom 16 is unlocked from the guide member 24. As a result, hydraulic motor 21 may be operated to retract and extend boom 16 between the operative position in FIG. 1 and the transport position in FIG. 2. Stated otherwise, because drill head 27 is locked to the guide member 24 and I-beam 17 is longitudinally slidable relative to guide member 24, forward movement of hydraulic motor 21 will act through chains 18 to pull I-beam 17 longitudinally rearward. This occurs because drill head 27 is locked in place and I-beam 17 is not. Conversely, reverse operation of hydraulic motor 21 will pull I-beam 17 forward to the operating position shown in FIG. 1.

With boom 16 withdrawn to the transport position represented by phantom lines in FIG. 2, the apparatus 11 may be transported from one place to another. During transport, boom locking mechanism 64 must be in the locking position shown in FIG. 9A to prevent sliding movement of the beam 16 during transport.

When directional boring machine 11 is moved to a desired position for a boring operation, boom locking mechanism 64 is operated to retract the locking pins 74 from the selected pair of opposed apertures 35, and hydraulic motor 21 is operated in the reverse direction to extend boom 16 relative to the underlying guide member 24. When this operating position is reached, actuators 26 are retracted to pivot boom 16 downward to the position shown in FIG. 1, and the drilling operation may begin. This is accomplished as described above by threading one or more stems 32 to the spindle 29 and simultaneously operating hydraulic motor 31 to rotate the drill stems 32 and drill bit 34 and hydraulic motor 21 to advance the drill head 27 down boom 16. When drill head 27 reaches the end of the boom 16, drill stem clamp 33 is actuated to unscrew the drill stem 32 from spindle 29, and additional drill stems 32 are added as necessary to obtain an underground bore of proper length.

If an obstacle is encountered during the drilling operation that cannot be overcome by advancement of the drill head 27 through the use of chains 18, drill head locking mechanism 28 is actuated by extending actuator 59 So that the sliding bars 61 move inward into abuttable engagement with a selected pair of teeth 63. Thereafter, the large hydraulic actuators 54 are extended as shown in FIG. 3 and hydraulic motor 31 is simultaneously operated. The combined power of actuators 54 with hydraulic motor 31 and chains 18 is sufficient to overcome most if not all obstacles that the directional boring machine 11 may encounter.

When the boring operation is completed, the drill stems 32 are sequentially removed through the use of the clamping mechanism 33 and retraction of drill head 27. After all drill stems 32 have been removed, boom 16 may be pivoted upward and retracted for transport as shown in FIG. 2.

I claim:

1. An earth boring machine comprising:

carriage means;

longitudinal boom means mounted on the carriage means;

drill head means movably and guidably mounted on the boom means for longitudinal movement thereon, the drill head means including drill means for rotatably boring a hole;

first drive means for drivably moving the drill head means on said boom means in forward and reverse directions; and second drive means comprising:

frame means guidably mounted on the boom means for movement with said drill head means;

locking means for releasably locking the frame means to said boom means; and actuator means disposed between the frame means and the drill head for extending the drill head means relative to the frame means under a force that supplements the first drive means, and for retracting the drill head means relative to the frame means.

2. An earth boring machine comprising:

carriage means;

longitudinal boom means mounted on the carriage means;

guide means for connecting the boom means to the carriage means for longitudinal movement with respect thereto between extended and retracted positions;

drill head means mounted on the boom means for guided longitudinal movement thereon, the drill head means including drill means for rotatably boring a hole;

reversible power means for moving the drill head means forwardly and rearwardly on said boom means;

first locking means for releasably locking the boom means to the guide means; and second locking means for releasably locking the drill head means to the guide means;

the reversible power means and the first and second locking means being constructed and arranged so that upon locking the first locking means and releasing the second locking means the power means may be operated to move said drill head means on the boom means for drilling operations, and upon releasing the first locking means and locking the second locking means, the power means may be operated to extend and retract the boom means.

3. The earth boring machine defined by claim 1, wherein the first drive means comprises chain means having first and second chain ends and formed into an elongated loop having first and second loop ends, idler sprocket means operably engaging the first loop end and drive sprocket means operatively engaging the second loop end, the first chain end being connected to the forward end of the drill head means and the second chain end being connected to the rearward end of the drill head means.

4. The earth boring machine defined by claim 1, wherein the longitudinal boom means comprises a plurality of stationary teeth members spaced longitudinally thereon, and the locking means comprises movable teeth engaging means carried by the frame means, the teeth engaging means being movable between retracted nonengaging and extended teeth engaging positions, and actuator means for extending and retracting the teeth engaging means.

5. The earth boring machine defined by claim 1 which further comprises:

guide means for connecting the boom means to the carriage means for longitudinal movement with respect thereto between extended and retracted positions;

boom locking means for releasably locking the boom means to the guide means; and drill head locking means for releasably locking the drill head means to the guide means;

the boom locking means and the drill head locking means being constructed and arranged so that upon locking the boom locking means and releasing the drill head locking means the first drive means may be operated to move said drill head means on the boom means for drilling operations, and upon releasing the boom locking means and locking the drill head locking means the first drive means may be operated to extend and retract the boom means.

6. The earth boring machine defined by claim 2, wherein the boom means is pivotally mounted to the carriage means, and further comprising actuator means operably connected between the carriage means for pivotally moving the boom means and holding it in a predetermined position.

7. The earth boring machine defined by claim 2, wherein the boom means comprises an I-beam and the guide means comprises a guide member disposed below the I-beam, the guide member being constructed to slidably mate with the I-beam.

8. The earth boring machine defined by claim 2, wherein the reversible power means comprises chain means having first and second ends and formed into an elongated loop having first and second loop ends, idler sprocket means operably engaging the first loop end, and drive sprocket means operably engaging the second loop end, the first chain end being connected to the forward end of the drill head means and the second chain end being connected to the rearward end of the drill head means.

9. The earth boring machine defined by claim 2, wherein the first locking means comprises a plurality of locking apertures formed in the boom means at longitudinally spaced intervals, locking pin means carried by the guide means for movement between a retracted nonengaging position and an extended position in which the locking pin means lockably projects into a selected locking aperture, and actuator means for extending and retracting the locking pin means.

10. The earth boring machine defined by claim 2, wherein the second locking means comprises locking pocket means carried by the guide means, locking pin means carried by the drill head means for movement between a retracted nonengaging position and an extended position in which the locking pin means lockably projects into the locking pocket means, and actuator means for extending and retracting the locking pin means.

* * * * *